US008733315B2

(12) United States Patent
Kollotzek et al.

(10) Patent No.: US 8,733,315 B2
(45) **Date of Patent: *May 27, 2014**

(54) CASTING CORE FOR FORMING A COOLING CHANNEL IN A PISTON

(75) Inventors: Helmut Kollotzek, Mutlangen (DE); Thomas Hettich, Schwieberdingen (DE); Frank Ehmann, Affalterbach (DE)

(73) Assignee: Mahle International GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/480,200

(22) Filed: May 24, 2012

(65) Prior Publication Data

US 2012/0325166 A1 Dec. 27, 2012

(30) Foreign Application Priority Data

May 25, 2011 (DE) ..... 10 2011 076 455

(51) Int. Cl.
*F02F 3/00* (2006.01)

(52) U.S. Cl.
USPC ..... 123/193.1; 123/41.35; 123/193.3; 29/888.01; 29/889.721

(58) Field of Classification Search
USPC ..... 123/41.35, 41.36, 41.44, 41.01, 193.1, 123/193.6; 29/888.01, 888.04, 888.072, 29/888.076, 889.721; 164/271, 369, 348, 164/373
See application file for complete search history.

(56) References Cited

U.S. PATENT DOCUMENTS

| | | | | |
|---|---|---|---|---|
| 3,459,253 | A | 8/1969 | Woolcott | |
| 5,845,611 | A * | 12/1998 | Schmidt et al. | 123/41.35 |
| 6,499,386 | B2 * | 12/2002 | Martin et al. | 92/186 |
| 7,748,361 | B2 * | 7/2010 | Linz et al. | 123/193.6 |
| 2008/0289490 | A1 | 11/2008 | Linz et al. | |
| 2010/0163203 | A1 * | 7/2010 | Kollotzek | 164/369 |
| 2011/0120299 | A1 | 5/2011 | Aro | |
| 2011/0174245 | A1 * | 7/2011 | Kollotzek | 123/41.39 |
| 2011/0180025 | A1 | 7/2011 | Freidhager | |

FOREIGN PATENT DOCUMENTS

| | | | |
|---|---|---|---|
| DE | 19804168 | A1 | 8/1998 |
| DE | 102004043720 | A1 | 3/2006 |
| DE | 102007020384 | A1 | 11/2008 |
| DE | 102008002571 | A1 | 12/2009 |
| DE | 102008038324 | A1 | 2/2010 |
| JP | 61-1446 | | 1/1986 |
| WO | WO-2008/131754 | A1 | 11/2008 |

OTHER PUBLICATIONS

English abstract for DE-19804168.
English abstract for DE-102007020384.

* cited by examiner

*Primary Examiner* — Noah Kamen
*Assistant Examiner* — Long T Tran
(74) *Attorney, Agent, or Firm* — Rader, Fishman & Grauer PLLC

(57) ABSTRACT

A soluble and substantially ring-shaped casting core may include a cooling channel in a piston having at least one inflow and at least one outflow. The casting core may form a closed ring and the inflow may be arranged directly adjacent to the outflow. The casting core may have a cross-sectional taper for forming a choke in the circumferential direction between the inflow and the outflow.

20 Claims, 1 Drawing Sheet

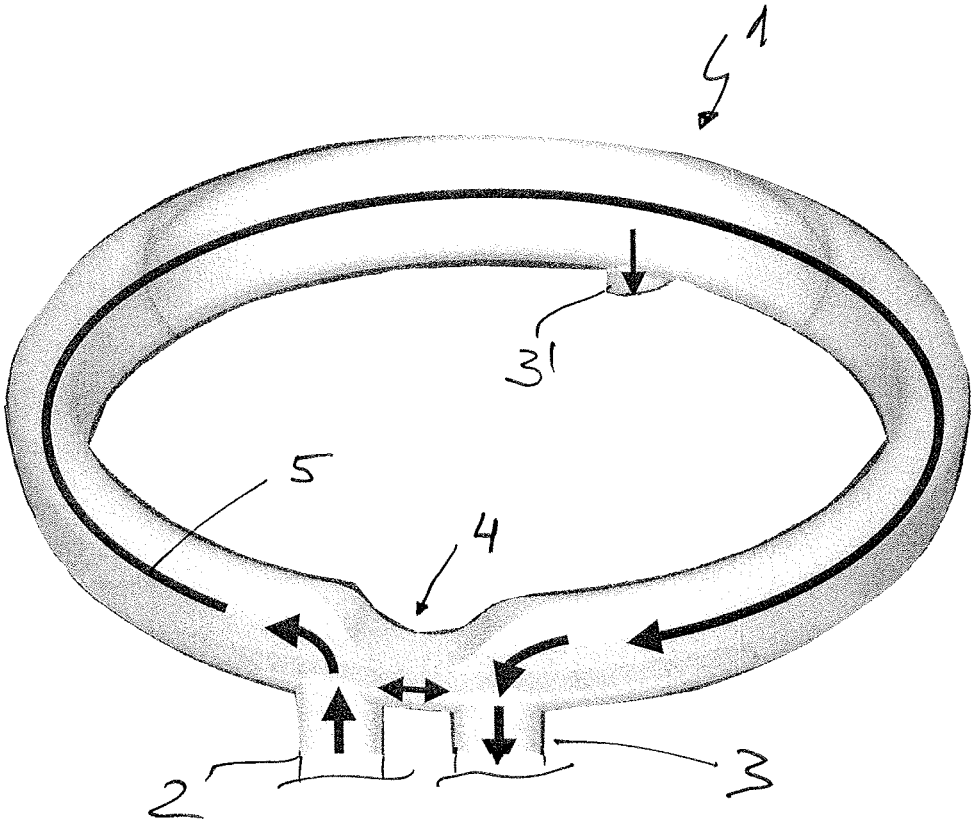
1
31
5
4
2
3

CASTING CORE FOR FORMING A COOLING CHANNEL IN A PISTON

CROSS-REFERENCE TO RELATED APPLICATIONS

This application claims priority to German Patent Application 10 2011 076 455.0 filed on May 25, 2011, which is hereby incorporated by reference in its entirety.

TECHNICAL FIELD

The present invention relates to a soluble and substantially ring-shaped casting core for forming a cooling channel in a piston of a combustion engine according to the preamble of claim 1. The invention additionally relates to a cast piston having a cooling channel produced by such a casting core.

BACKGROUND

From WO 2008/131754 A1 a generic, soluble and substantially ring-shaped casting core for forming a cooling channel in a piston of a combustion engine is known. Here, the casting core comprises at least one inflow and at least one outflow. In the region of the inflow and of the outflow, the cooling channel merges into two regions that are arranged approximately parallel to the piston axis and face away from the piston base in each case via a quarter of a circle-shaped core bend, wherein one of the regions merges into a part of the casting core that forms the inflow of the cooling channel, whereas the other part of the casting core merges into the region forming the outflow. In the two regions of the casting core in this case are arranged at a distance from each other which maximally corresponds to double the cross sectional diameter of one of the two regions, as a result of which the through-flow of the cooling oil flowing through the cooling channel is to be accelerated and the cooling of the piston improved.

From DE 10 2004 043 720 A1 a cooling channel with a single inflow opening and two separate outflow openings is known, as a result of which no impairment of the coolant outflow is to occur on the respective outflow opening.

From DE 10 2008 038 324 A1 a piston with a cooling channel is known, which is substantially designed ring-shaped and has two separate inflow openings as well as two separate outflow openings. Between the outflow openings a cross-sectional constriction acting as a choke is provided.

Disadvantageous with casting cores known from the prior art is that on the one hand these are difficult to handle because of their fragility and on the other hand their design often makes possible merely an unsatisfactory cooling of the piston.

SUMMARY

The present invention therefore deals with the problem of stating an improved or at least an alternative embodiment for a casting core of the generic type, which is characterized in particular by a simplified handling.

According to the invention, this problem is solved through the subjects of the independent claims. Advantageous embodiments are the subject of the dependent claims.

The present invention is based on the general idea, on the one hand, of forming a casting core used during the casting of pistons and for producing a cooling channel in the piston in a more stable manner and change its shape such that the coolant in the cooling channel is able to flow better in the later piston, thus being able to better cool the piston. To this end, the soluble casting core according to the invention forms a closed ring, on which an inflow to the cooling channel is arranged directly adjacent to the outflow from the cooling channel, wherein the casting core additionally comprises a cross-sectional taper for forming a choke in circumferential direction between the inflow and the outflow. Through the closed spring of the casting core, the latter is clearly more stable and thus less sensitive compared for example with a horse shoe-like shape, as a result of which working with such a casting core is simplified. Through the annular shape of the casting core and the connection between the inflow and the outflow and the provision of a cross-sectional taper in the region between the inflow and the outflow, the piston cannot only be cooled in a 360° circumference, but the coolant flow in the cooling channel can also be individually controlled depending on the design of the choke. Through the connection between the inflow and the outflow and thus through the completely closed annular shape of the casting core and thus also of the later cooling channel, cooling compared with previous casting cores of horse shoe-shaped design can be clearly improved. With the cross-sectional taper provided according to the invention, an unambiguously directed coolant flow and thus a flow direction in the later cooling channel can be additionally enforced, wherein via the connection between the inflow and the outflow a uniform cooling of the piston is guaranteed.

With an advantageous further development of the solution according to the invention, the casting core is designed as salt core. Salt cores as casting cores already have a long tradition and make possible a high-quality production even of branched-out structures. Here, salt constitutes a natural mineral which cannot only be won cost-effectively, but can also be recycled, which with respect to a steadily growing environmental awareness is of great interest. Obviously, the casting core in this case can also be formed as sand core as an alternative, as a result of which similar advantages as the formation as salt core can be achieved.

With a further advantageous embodiment of the solution according to the invention, the casting core with the exception of the region directly between the inflow and the outflow, has a cross section that remains the same. Because of this, a particularly simple cooling channel geometry can be created, wherein because of the cross section of the casting core that remains the same and in particular of the same size, said casting core is not weakened anywhere and because of this has a higher stability, as a result of which its handling and its use are facilitated.

Further important features and advantages of the invention are obtained from the subclaims, from the drawing and from the associated FIGURE description by means of the drawing.

It is to be understood that the features mentioned above and still to be explained in the following cannot only be used in the respective combination stated, but also in other combinations or by themselves, without leaving the scope of the present invention.

A preferred exemplary embodiment of the invention is shown in the drawing and is explained in more detail in the following description.

BRIEF DESCRIPTION OF THE DRAWINGS

The only FIG. 1 shows a possible embodiment of a casting core according to the invention.

DETAILED DESCRIPTION

According to FIG. 1, a casting core 1 according to the invention for forming a cooling channel in a cast piston of a combustion engine comprises at least one inflow 2 and at least one outflow 3. According to the invention, the casting core 1 is now designed as a closed ring and has a cross-sectional taper 4 for forming a choke between the inflow 2 and the outflow 3. By forming the casting core 1 as a ring that is closed over the full circumference, its stability is clearly increased and because of this its handling simplified, since its sensitivity can be greatly reduced. Here, the inflow 2 is arranged directly adjacent to the inflow 3.

Advantageously, the casting core 1 in this case is designed as sand core or as salt core, wherein both materials are generally recyclable and because of this also satisfy high environmental standards. In addition, both sand and salt are a natural resource that is available in large quantities, the extraction of which is possible in an environmentally compatible manner.

Considering the FIG. 1 further, it is evident that the inflow 2 and the outflow 3 are orthogonally orientated to the ring plane of the casting core 1, wherein obviously a further outflow 3' can be provided, which can then be likewise orientated orthogonally to the ring plane of the casting core 1. The arrows shown in FIG. 1 in this case are flow arrows 5, which illustrate a coolant flow in a later cooling channel of a piston which is not shown formed through the casting core 1.

Except for the region between the inflow 2 and the outflow 3 arranged directly adjacent thereto, the casting core 1 can have a cross section that remains the same, wherein the provision of additional cross-sectional tapers 4 at another point is obviously also conceivable.

A piston produced with the casting core 1 according to the invention can for example be embodied as steel piston and employed in conventional combustion engines, for example in motor vehicles or commercial vehicles. The general advantages of the casting core 1 according to the invention lie in particular in its clearly increased stability and the 360° cooling of the piston made possible because of the annularly closed shape.

The invention claimed is:

1. A soluble and substantially ring-shaped casting core, comprising: a cooling channel in a piston having at least one inflow and at least one outflow, wherein the casting core forms a closed ring, wherein the inflow is arranged directly adjacent to the outflow, and wherein the casting core in circumferential direction between the inflow and the outflow has a cross-sectional taper for forming a choke.

2. The casting core according to claim 1, wherein the casting core is as at least one of a salt core and a sand core.

3. The casting core according to claim 2, wherein at least one of the inflow and the outflow are orientated orthogonally to a ring plane of the casting core.

4. The casting core according to claim 3, wherein the casting core except for the region between the inflow and the outflow has a consistent cross section.

5. The casting core according to claim 4, further comprising at least one of a second inflow and a second outflow.

6. The casting core according to claim 2, wherein the casting core except for the region between the inflow and the outflow has a consistent cross section.

7. The casting core according to claim 2, further comprising at least one of a second inflow and a second outflow.

8. The casting core according to claim 1 wherein at least one of the inflow and the outflow are orientated orthogonally to a ring plane of the casting core.

9. The casting core according to claim 3, further comprising at least one of a second inflow and a second outflow.

10. The casting core according to claim 1, wherein the casting core except for the region between the inflow and the outflow has a consistent cross section.

11. The casting core according to claim 1, further comprising at least one of a second inflow and a second outflow.

12. A cast piston for a combustion engine, comprising: an internally located annular cooling channel for cooling the piston during the operation of a combustion engine, wherein the cooling channel is produced by a casting core forming a cooling channel in the piston having at least one inflow and at least one outflow, wherein the casting core forms a closed ring, wherein the inflow is arranged directly adjacent to the outflow, and wherein the casting core in circumferential direction between the inflow and the outflow has a cross-sectional taper for forming a choke.

13. A piston according to claim 12, wherein the piston is a steel piston.

14. The casting core according to claim 13, wherein at least one of the inflow and the outflow are orientated orthogonally to a ring plane of the casting core.

15. The casting core according to claim 14, wherein the casting core except for the region between the inflow and the outflow has a consistent cross section.

16. The casting core according to claim 15, further comprising at least one of a second inflow and a second outflow.

17. The casting core according to claim 12, wherein the casting core is at least one of a salt core and a sand core.

18. The casting core according to claim 12, wherein at least one of the inflow and the outflow are orientated orthogonally to a ring plane of the casting core.

19. The casting core according to claim 12, wherein the casting core except for the region between the inflow and the outflow has a consistent cross section.

20. The casting core according to claim 12, further comprising at least one of a second inflow and a second outflow.

* * * * *